US010081996B2

(12) United States Patent
Krieg et al.

(10) Patent No.: US 10,081,996 B2
(45) Date of Patent: Sep. 25, 2018

(54) ONE TRIP TUBULAR CUTTING AND MILLING DOWN TUBE AND ASSOCIATED COLLARS

(71) Applicant: BAKER HUGHES INCORPORATED, Houston, TX (US)

(72) Inventors: George N. Krieg, Broussard, LA (US); David J. Joyner, Houma, LA (US); Ryan C. Holcomb, Houma, LA (US); Jake H. Taylor, Crowley, LA (US)

(73) Assignee: Baker Hughes, a GE company, LLC, Houston, TX (US)

( * ) Notice: Subject to any disclaimer, the term of this patent is extended or adjusted under 35 U.S.C. 154(b) by 422 days.

(21) Appl. No.: 14/795,655

(22) Filed: Jul. 9, 2015

(65) Prior Publication Data

US 2017/0009546 A1 Jan. 12, 2017

(51) Int. Cl.
*E21B 29/00* (2006.01)
*E21B 23/04* (2006.01)

(52) U.S. Cl.
CPC ..... *E21B 29/005* (2013.01); *E21B 23/04* (2013.01)

(58) Field of Classification Search
CPC ..... E21B 29/002; E21B 29/005; E21B 23/04; E21B 29/00
See application file for complete search history.

(56) References Cited

U.S. PATENT DOCUMENTS 2,353,284 A * 7/1944 Barrett ..... B23B 5/16 166/55.8
2,899,000 A * 8/1959 Medders ..... E21B 29/002 166/55.8
5,074,355 A * 12/1991 Lennon
5,265,675 A * 11/1993 Hearn ..... E21B 10/322 166/297
5,735,359 A * 4/1998 Lee ..... E21B 10/322 175/269
5,765,640 A 6/1998 Milne
6,920,923 B1 * 7/2005 Pietrobelli ..... E21B 29/005 166/55.2
7,909,100 B2 * 3/2011 Bryant, Jr. ..... E21B 29/005 166/298
8,141,627 B2 3/2012 Krieg et al.
8,555,955 B2 * 10/2013 Davis ..... E21B 10/66 166/298
8,839,864 B2 * 9/2014 Beynon ..... E21B 29/005 166/297

(Continued)

*Primary Examiner* — Michael R Wills, III
(74) *Attorney, Agent, or Firm* — Steve Rosenblatt

(57) ABSTRACT

In a plug an abandon environment with casing and a tubular string running through the casing a tool is placed at a desired location for a severing of the inner tubular. A first set of blades is extended from a housing to cut radially until the inner tubular is severed. A second set of blades are then extended for axial milling with a reach limit of the outside wall of the severed tubular at a location between upsets. As the axial milling reaches an upset, the second set of blades is allowed to retract and a third set with a longer reach is extended to axially mill the upset. Thereafter the third set of blades is allowed to retract and the second set is extended to continue axial milling. The second and third sets of blades can be reversed so that initial axial milling can be at the upset rather than between the upsets followed by milling between the upsets with the shorter reach blades.

26 Claims, 4 Drawing Sheets

(56) References Cited

U.S. PATENT DOCUMENTS

| | | | | |
|---|---|---|---|---|
| 8,955,597 | B2 | 2/2015 | Connell et al. | |
| 9,022,117 | B2 * | 5/2015 | Segura | E21B 29/002 166/298 |
| 2012/0186817 | A1 * | 7/2012 | Gibson | |
| 2013/0199785 | A1 * | 8/2013 | Hekelaar | |
| 2013/0292108 | A1 * | 11/2013 | Hutchinson | E21B 29/005 166/55.8 |
| 2015/0354306 | A1 * | 12/2015 | Fuller | E21B 29/005 166/285 |

* cited by examiner

ONE TRIP TUBULAR CUTTING AND MILLING DOWN TUBE AND ASSOCIATED COLLARS

FIELD OF THE INVENTION

The field of the invention is a one trip apparatus and method where multiple tools can be sequentially operated multiple times and more specifically where a tubular can be radially severed and then axially milled with blades with different extensions to allow milling through the tubular wall between upsets with one blade and through upsets with another blade which can be alternately extended to facilitate a cut and abandon operation in a borehole.

BACKGROUND OF THE INVENTION

Occasions arise where a well has to be plugged and abandoned. Typically, such wells will have a cemented casing and another tubular string inside the casing. The plug and abandon procedure involves severing the inner tubular followed by axially milling the severed tubular for a predetermined axial distance followed by setting a plug and depositing cement on top of the plug. The tubular to be severed has a nominal outer dimension between upsets at opposed ends where the joints occur. The axial milling has to cut the nominal dimension as well as the upset outer dimension. In either case it is not desirable to cut into the surrounding tubular as the integrity of the surrounding tubular is important to the functioning of the plug created as part of the abandonment process. On some occasions the tubular to be severed and axially milled is not disposed concentrically in the surrounding casing and sometimes the inner tubular lies on the casing. Axially milling the severed tubular involves using blades that extend a predetermined amount that is short of reaching the surrounding tubular.

The way this process is done today takes multiple trips. The first trip is with a mill with extending blades whose pointed ends radially penetrate the wall of a tubular until that wall is breached. These blades are limited in their radial extent to avoid damage to the surrounding tubular. The tool is then tripped out for a blade replacement to dress the tool with blades that will axially mill the nominal outside diameter of the tubular in a location where the severing took place, which is generally between upsets that have an even larger outer dimension. The axial milling continues between the upsets until an upset is reached. At that point there is another trip out of the hole to redress the tool with longer axial milling bladed that can reach further to the exterior of the larger upset dimension and yet not far enough to gouge the surrounding tubular. Should further axial milling be needed after an upset then another trip to swap back to the shorter axial milling blades is needed.

In one embodiment of the invention all three blade types are provided on a tool housing run into the tubular to be severed and then axially milled. The severing blades are initially extended for the radial cutting through the wall after which those blades are no longer needed. With the aid of specially configured darts that land in a profile either the shorter or the longer axial milling blades are extended. The uniquely configured darts are blown out into a catcher to allow selection of the longer or the shorter blades alternatively as many times as needed depending on the length of the axial milling distance and how many upsets need milling in that desired interval. No matter if the shorter or longer axial milling blades are extended, there is an open circulation path for the extended blades to cool them and for cuttings removal to a collection device or to the surface. While severing and milling is the preferred application, other uses are envisioned where there is a need to sequentially operate a variety of tools in a single trip particularly when two of the tools need to be alternatively operated multiple times. While the preferred actuation system is described in a hydraulic operating environment other ways to achieve the desired tool operating sequence are also contemplated with the objective being an economical and hence reliable design that can perform the required actions in a single trip and preferably without well intervention.

U.S. Pat. No. 8,955,597 shows a sequential use of a mill to make a radial cut with blades 76 followed by extension of a reamer 84 to enlarge the opening where the casing was earlier milled away. This application is limited to a single string in the hole and the sequence is executed but a single time. U.S. Pat. No. 5,765,640 describes a multipurpose tool where one or more pistons can be used to operate multiple tools at the same or different times but shows or describes no structure as to how that can be done one time, not to mention multiple times. U.S. Pat. No. 8,141,627 shows multiple rows of cleaning blades that extend at the same time and are spring retracted.

Those skilled in the art will have a better understanding of the preferred embodiment of the invention from the description below and the associated drawings while recognizing that the full scope of the invention is to be determined from the appended claims.

SUMMARY OF THE INVENTION

In a plug an abandon environment with casing and a tubular string running through the casing a tool is placed at a desired location for a severing of the inner tubular. A first set of blades is extended from a housing to cut radially until the inner tubular is severed. A second set of blades are then extended for axial milling with a reach limit of the outside wall of the severed tubular at a location between upsets. As the axial milling reaches an upset, the second set of blades is allowed to retract and a third set with a longer reach is extended to axially mill the upset. Thereafter the third set of blades is allowed to retract and the second set is extended to continue axial milling. The alternating use of the second and third blade sets continues until the desired axial distance is milled out. The second and third sets of blades can be reversed so that initial axial milling can be at the upset rather than between the upsets followed by milling between the upsets with the shorter reach blades.

DETAILED DESCRIPTION OF THE PREFERRED EMBODIMENT

Figure 1A:
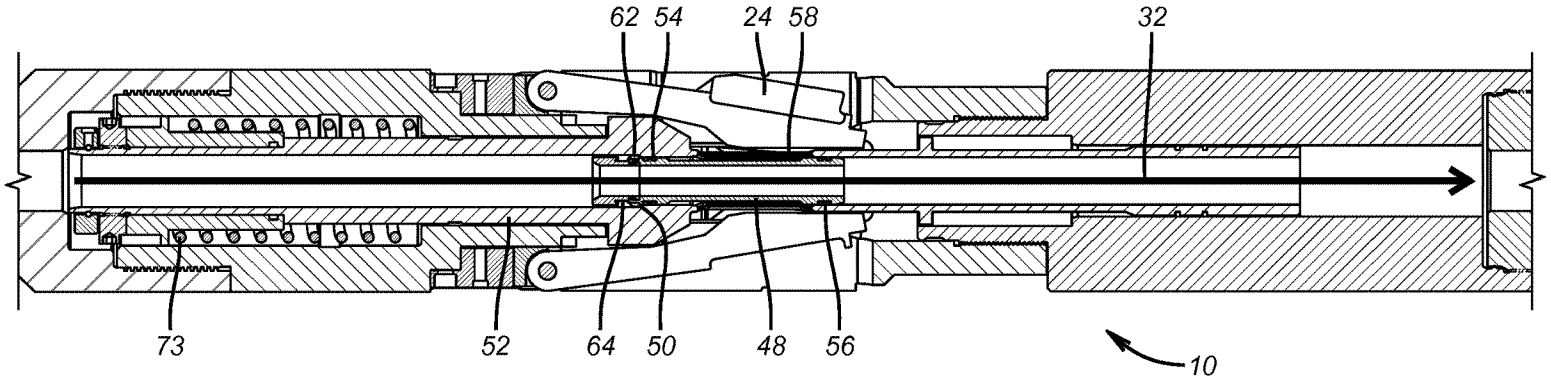
FIGS. 1*a* and 1*b* show the tool after a tubular is severed and the first set of blades are isolated to prevent their subsequent extension and to permit extension of the second set of blades.
Figure 1B:
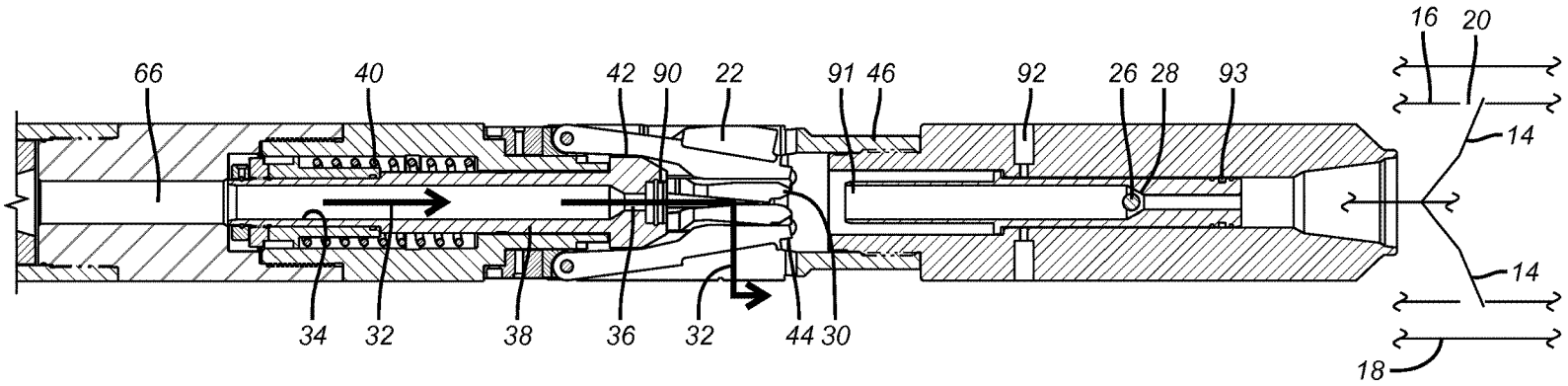

The layout of the tool 10 is shown in FIGS. 1*a* and 1*b*. At the lower end a known section mill is schematically illustrated that has a series of first blades 14 that extend when flow through a restriction in a piston displaces that piston against a spring bias to force out first blades 14 to radially cut the inner tubular 16 but without reaching the surrounding casing or tubular string 18. The radial cut 20 will be the start location for axial milling with second blades and third blades 24 as will be explained below.

The shear sleeve 91 is initially affixed to the piston 38 across area 90 which prevents piston 38 from extending knives 22. The sleeve 91 is secured using a number of shear screws installed in 92 and attached to the component in groove 93.

Once tubular is severed a ball 26 lands on seat 28 to apply pressure and shear screws 92 allowing sleeve 91 to shift downwards, disable the blades 14 on the mill, allow piston 38 to activate knives 22 and open ports 30.

Thus, flow represented by arrows 32 passes through passage 34 and restriction 36 to create a force to move the piston 38 against the bias of spring 40. This allows piston 38 to shift right bringing an enlarged diameter 42 into alignment with second blades 22 to push them out radially until a lower end surface 44 hits the housing 46 for a radial travel stop for second blades 22. When against the stop the extension of second blades 22 from the housing 46 is just enough to go through the wall of the tubular 16 in a region between upsets that occur at opposite ends of a typical joint of tubular. It should be noted that the positions of blades 22 and 24 can be reversed so that blades 24 that are longer can be in the position where blades 22 are shown in the drawings and vice versa. The tool operation is otherwise the same but the upset is milled before the length between the upsets.

The reason pressure from the surface can reach the passage 34 in piston 38 is that further uphole a first dart 48 is landed at shoulder 50 of piston 52. First dart 48 is a tube with spaced exterior seals 54 and 56 that straddle openings 58 near third blades 24. First dart 48 is in pressure balance to flow through piston 52. Arrow 32 in piston 52 schematically illustrates the latter reality and the continuing communication of pressure to orifice 36 in piston 38 for extension of second blades 22.

Figure 2:
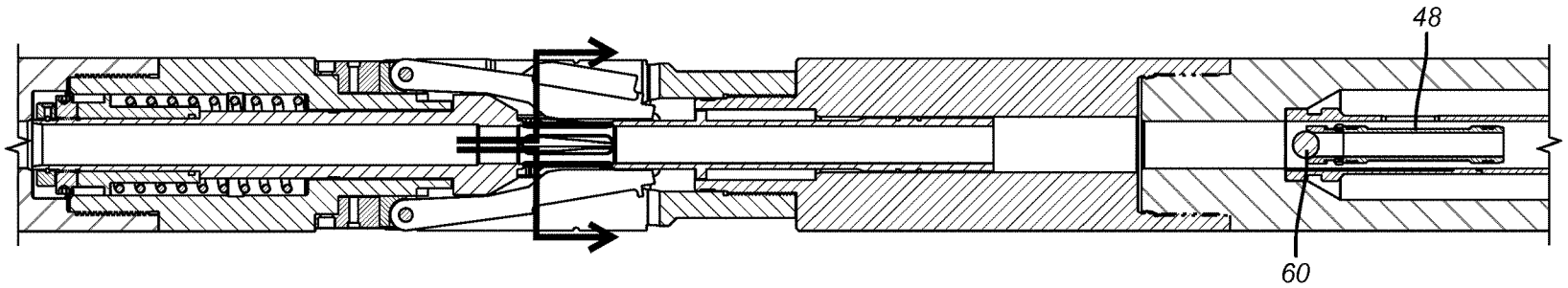
FIG. 2 shows the blown out position of a first dart which had previously enabled the extension of the second set of blades by straddling ports by a third set of blades as shown in FIG. 1*a;*

After a certain distance of axial milling with second blades 22 is accomplished there is a need to allow them to retract and extend third blades 24 to continue axial milling through an upset (not shown) in the tubular 16 that has the initial sever 20. To do this a ball 60 shown in FIG. 2 lands on the first dart 48 and both travel in tandem after a release from shoulder 50 in piston 52. The release happens when axial force on the landed ball 60 shears out a pin holding a collapsible ring 62 allowing it to move into a recess 64 to clear the shoulder 50. The first dart 48 is captured in a catcher volume 66 or in passage 34 of piston 38.

Figure 3:
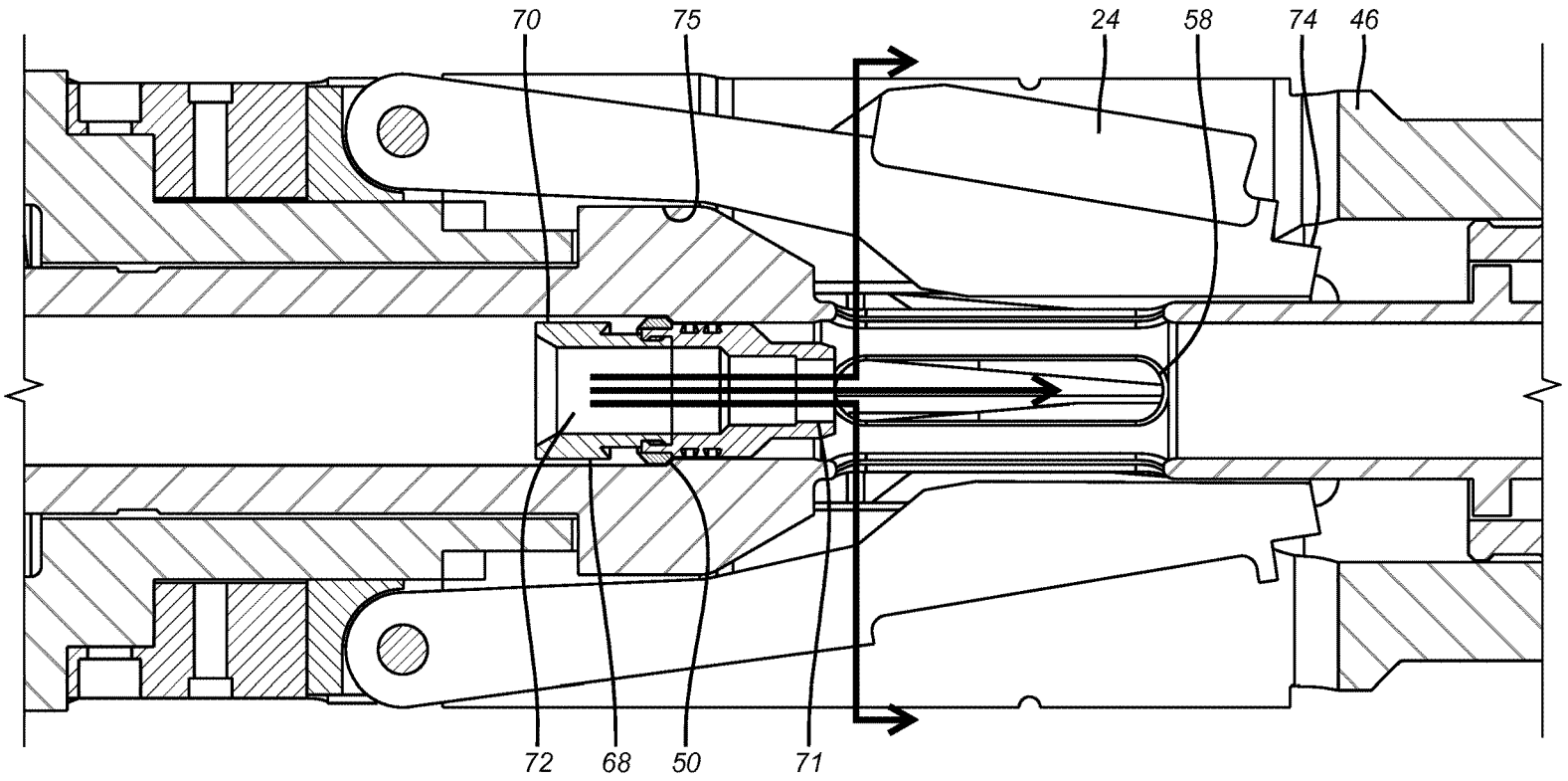
FIG. 3 shows a second dart landed where the first dart was previously landed leaving ports open by the third set of blades and enabling those blades to be extended.
Figure 4:
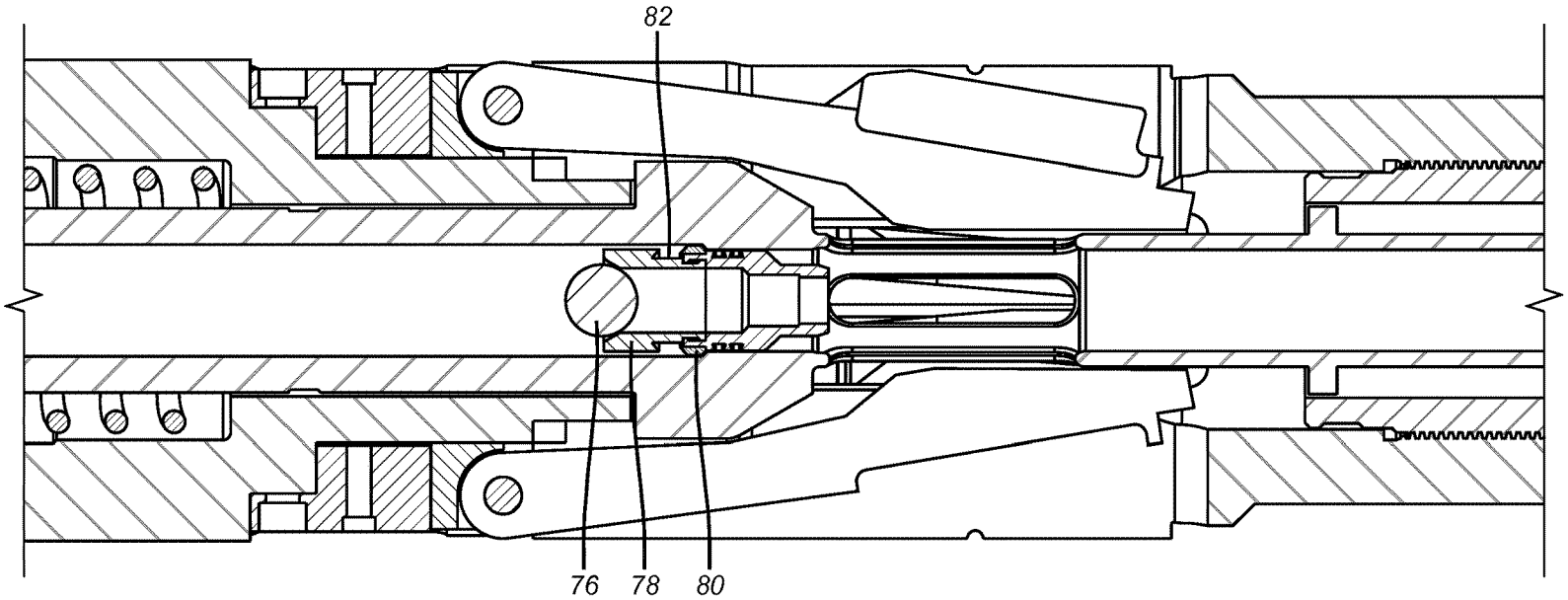
FIG. 4 shows a ball landed in the second dart to blow it out to enable another first dart to be introduced so that the second set of blades can again be extended.

FIG. 3 shows a second tubular dart 68 then landed on the same shoulder 50. However, second dart 68 leaves ports 58 uncovered. It has a flow restriction 71 in its passage 72. The open ports 58 present a path of least resistance to flow exiting restriction 71 so that the exiting fluid can cool the third blades 24 and remove the cuttings they generate. Lower end surface 74 serves as a radial travel stop for third blades 24 when engaging the housing 46. In the extended position the blades 24 reach out as far as the outer surface of the upset on the tubular 16 without reaching tubular 18. Although some flow can go through restriction 71 down to restriction 36 because ports 30 are open at this time, not enough force is generated on piston 38 to overcome the bias of spring 40 with the bulk of the fluid having exited further uphole at open ports 58. Once the need to extend blades 24 arises, a ball 76 is dropped on seat 78 to shear loose collapsing ring 80 that retracts into recess 82 so that the second dart 70 and the ball 76 can move into catcher volume 66 or passage 34 in the same manner that the first dart 48 went. Those skilled in the art will appreciate that the above can be repeated multiple times using the first and second darts to sequentially extend the second blades 22 followed by the third blades 24 as an upset is approached or in the reverse order with the longer and shorter blade positions reversed and then milled through causing the need to return to a smaller reach as the portion of a stand between the upsets is to be milled. This ability to switch back and forth between extending the second blades and third blades allows continuous milling of sting 16 between and through the upsets all without damage to the exterior string 18.

It should be noted that piston 52 is in pressure balance in FIG. 1*a* with first dart 48 landed in it. When second dart 70 is landed the flow through restriction 71 overcomes spring 73 to extend third blades 24. With flow removed the spring 73 retracts axially the wide portion 75 from third blades 24 so they can retract.

Those skilled in the art will appreciate that axial milling can continue with as many transitions between the second blades 22 and the third blades 24 as needed to remove upsets as they are encountered. Of course if any of the blades 22 or 24 wear out then the tool has to be removed and redressed. The blades are shown as pivotally mounted and the pivots can optionally have retraction springs to work in tandem with springs 40 and 73 to better ensure the blades 22 and 24 retract when they need to do so.

While the context of the device described above is for axial milling other applications are envisioned that require sequential operation of three tools for one or more cycles or at least two tools sequentially for more than one cycle. Such functions can be for anchoring, centralizing, sleeve shifting among other applications.

The above description is illustrative of the preferred embodiment and many modifications may be made by those skilled in the art without departing from the invention whose scope is to be determined from the literal and equivalent scope of the claims below:

We claim:

1. A multi-purpose tool assembly for subterranean use comprising:

a housing supporting at least two tubular milling tools, said tools selectively alternately extendable such that one of said milling tools is extended and milling while another is retracted followed by said another tubular milling tool extended and cutting while said one of said milling tools is retracted more than one time in a subterranean location to axially mill a tubular string both between upsets and through said upsets.

2. The assembly of claim 1, wherein:

said tools cut the tubular in parallel direction to said axis of said housing.

3. The assembly of claim 2, wherein:

said tools extend different distances from said axis of said housing when fully extended.

4. The assembly of claim 3, wherein:

a first of said tools comprises a first set of pivoting blades that reach an outer wall of the surrounding tubular between upsets to sever the surrounding tubular when fully extended and a second of said tools comprises a second set of pivoting blades that reach an outer dimension of said upsets for axial milling said upsets.

5. The assembly of claim 4, further comprising:

a third tool;

said third tool comprises a third set of pivoting blades for axial milling of the surrounding tubular between upsets.

6. The assembly of claim 5, wherein:

said first set of blades is extendible before said second or third set of blades for radially severing the surrounding tubular;

said first set of blades is disabled by hydraulic isolation after said surrounding tubular is severed.

7. The assembly of claim 6, wherein:

said housing comprising a passage with a ball seat to accept a ball to preclude pressure actuation of said first set of blades when said ball lands on said seat in said passage.

8. The assembly of claim 5, wherein:

said second and third set of blades respectively extendable by spaced primary and secondary fluid driven pistons in a passage in said housing, said pistons each associated with wall ports in said housing.

9. The assembly of claim 1, wherein:

said tools are operated with mechanical or hydraulic force.

10. A multi-purpose tool assembly for subterranean use comprising:

a housing supporting at least two tools, said tools selectively alternately operable more than one time in a subterranean location; said tools extend from said housing into contact with a surrounding tubular for cutting thereof, said tools cut the tubular in parallel direction to said axis of said housing; said tools extend different distances from said axis of said housing when fully extended; a first of said tools comprises a first set of pivoting blades that reach an outer wall of the surrounding tubular between upsets for severing the surrounding tubular when fully extended and a second of said tools comprises a second set of pivoting blades that extend to an outer dimension of said upsets for axial milling said upsets; a third tool; said third tool comprises a third set of pivoting blades for axial milling of the surrounding tubular between upsets.

11. The assembly of claim 10, wherein:

said second and third set of blades respectively extendable by spaced primary and secondary fluid driven pistons in a passage in said housing, said pistons each associated with wall ports in said housing;

said secondary fluid driven piston comprising a landing shoulder for a first tubular dart that seals off said wall ports associated with said third set of blades such that pressure in said passage actuates only said second set of blades with said primary piston.

12. The assembly of claim 11, wherein:

said first tubular dart comprising a ball seat such that when an object is landed on said seat, said first dart releases from said landing shoulder for capture elsewhere in said passage.

13. The assembly of claim 12, wherein:

said landing shoulder accepts a second tubular dart, after said first tubular dart, that does not seal off said wall ports associated with said third set of blades such that pressure in said passage actuates only said third set of blades with said secondary piston.

14. The assembly of claim 13, wherein:

said primary and secondary fluid driven pistons each comprising a through passage with a flow restriction therein.

15. The assembly of claim 13, wherein:

said second tubular dart comprising a ball seat such that when an object is landed on said seat of said second tubular dart, said second tubular dart releases from said landing shoulder for capture elsewhere in said passage.

16. A multi-purpose tool assembly for subterranean use comprising:

a housing supporting at least two tubular milling tools, said tools selectively alternately extendable such that one of said milling tools is extended and milling while another is retracted followed by said another tubular milling tool extended and cutting while said one of said milling tools is retracted more than one time in a subterranean location to mill a tubular string both between upsets and through said upsets;

said tools respectively extendable by spaced primary and secondary fluid driven pistons in a passage in said housing.

17. The assembly of claim 16, wherein:

said pistons each associated with wall ports in said housing communicating with said passage.

18. A multi-purpose tool assembly for subterranean use comprising:

a housing supporting at least two tools, said tools selectively alternately operable more than one time in a subterranean location;

said tools radially extend from an axis of said housing;

said tools respectively extendable by spaced primary and secondary fluid driven pistons in a passage in said housing, said pistons each associated with wall ports in said housing communicating with said passage;

said secondary fluid driven piston comprising a landing shoulder for a first tubular dart that seals off said wall ports associated with said secondary fluid driven piston such that pressure in said passage actuates only said primary fluid driven piston.

19. The assembly of claim 18, wherein:

said first tubular dart comprising a ball seat such that when an object is landed on said seat, said first tubular dart releases from said landing shoulder for capture elsewhere in said passage.

20. The assembly of claim 19, wherein:

said landing shoulder accepts a second tubular dart, after said first tubular dart, that does not seal off said wall ports associated with said secondary piston such that pressure in said passage actuates only said secondary piston.

21. A one trip method of sectioning and axially milling an inner tubular disposed in a surrounding tubular, said inner tubular comprising pipe joints having upsets at opposed ends comprising:

locating a multi-purpose tool at a desired subterranean location inside said inner tubular; extending a first blade set for radially cutting through the inner tubular from the tool without being able to reach said outer tubular;

alternately extending and retracting a second and third blade sets from the tool multiple times such that one of said second and third blade sets is extended while the other of said second and third blade sets is retracted for axially milling said inner tubular between and at upsets thereon without being able to reach said surrounding tubular.

22. The method of claim 21, comprising:

actuating said second and third blade sets with fluid driven primary and secondary pistons disposed in a passage of said tool, said pistons disposed respectively adjacent ports in said tool communicating with said passage.

23. A one trip method of sectioning and axially milling an inner tubular disposed in a surrounding tubular, said inner tubular comprising pipe joints having upsets at opposed ends comprising:

locating a multi-purpose tool at a desired subterranean location inside said inner tubular; extending a first blade set for radially cutting through the inner tubular from the tool without being able to reach said outer tubular;

sequentially extending a second and third blade sets from the tool for axially milling said inner tubular between and at upsets thereon without being able to reach said surrounding tubular;

extending at least one of said second and third blade sets more than once in said single trip;

actuating said second and third blade sets with fluid driven primary and secondary pistons disposed in a passage of said tool, said pistons disposed respectively adjacent ports in said tool communicating with said passage;

landing a first tubular dart on said secondary piston such that said associated port for said secondary piston is blocked;

applying pressure in said passage with said first tubular dart in said secondary piston to fluidly actuate said primary piston.

24. The method of claim 23, comprising:

blowing out said first tubular dart before landing a second tubular dart on said secondary piston that does not block said ports associated with said secondary piston;

providing pressure in said passage to actuate said secondary piston.

25. The method of claim 24, comprising:

blowing out said second tubular dart after said actuating of said secondary piston;

retaining said first and second tubular darts in said passage after said blowing out.

26. The method of claim 25, comprising:

repeating said landing and blowing out of said first and second tubular darts to axially mill between and through as many upsets as desired on said inner tubular.

* * * * *